US009507295B2

(12) United States Patent
Ishizumi et al.

(10) Patent No.: US 9,507,295 B2
(45) Date of Patent: Nov. 29, 2016

(54) IMAGE FORMING APPARATUS

(71) Applicant: CANON KABUSHIKI KAISHA, Tokyo (JP)

(72) Inventors: Keisuke Ishizumi, Hiratsuka (JP); Shinsuke Kobayashi, Yokohama (JP); Shinji Katagiri, Yokohama (JP); Shuichi Tetsuno, Kawasaki (JP); Masaru Ohno, Ebina (JP); Satoshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 14/507,515

(22) Filed: Oct. 6, 2014

(65) Prior Publication Data

US 2015/0098719 A1 Apr. 9, 2015

(30) Foreign Application Priority Data

Oct. 8, 2013 (JP) ..... 2013-211273

(51) Int. Cl.
*G03G 15/00* (2006.01)
*G03G 15/16* (2006.01)

(52) U.S. Cl.
CPC ..... *G03G 15/161* (2013.01); *G03G 15/5058* (2013.01)

(58) Field of Classification Search
USPC ..... 399/49
See application file for complete search history.

(56) References Cited

U.S. PATENT DOCUMENTS 4,493,256 A * 1/1985 Hyllberg ..... B41F 13/18 101/216
2006/0146365 A1* 7/2006 Sugita ..... H04N 1/00236 358/1.15
2006/0285863 A1* 12/2006 Noguchi ..... G03G 15/5033 399/49
2013/0259506 A1* 10/2013 Katagiri ..... G03G 15/1675 399/66

FOREIGN PATENT DOCUMENTS

JP 2001-255761 A 9/2001
JP 2009-128715 A 6/2009
JP 2012-137733 A 7/2012
JP 2012-230250 A 11/2012

OTHER PUBLICATIONS

JP2012-137733 (A) English Machine Translation available from JPO website, retrieved Dec. 7, 2015.*

* cited by examiner

*Primary Examiner* — Minh Phan
(74) *Attorney, Agent, or Firm* — Canon USA, Inc., IP Division

(57) ABSTRACT

A Zener diode contacts an inner periphery surface of an intermediate transfer belt, and an opposing roller which opposes a detecting member is electrically insulated, in a configuration where transfer is performed at multiple photosensitive drums while an electrical current is applied in a peripheral direction of the intermediate transfer belt.

12 Claims, 13 Drawing Sheets

IMAGE FORMING APPARATUS

BACKGROUND

Field of the Invention

The present disclosure relates to an electrophotography system image forming apparatus, such as a copier, printer, or the like.

Description of the Related Art

There has been known an electrophotography system image forming apparatus which has an intermediate transfer member. This image forming apparatus transfers a toner image formed on the surface of a photosensitive drum serving as an image bearing member, onto the intermediate transfer belt by applying voltage from a voltage power supply to a primary transfer member disposed at a position facing the photosensitive drum, as a primary transferring step. Subsequently, this primary transferring step is repeated for multiple toner image colors, thereby forming a toner image of multiple colors on the surface of the intermediate transfer medium. Thereafter, the multiple-color toner image formed on the surface of the intermediate transfer medium is transferred all at once onto a recording medium such as paper or the like, by applying voltage to a secondary transfer member, as a secondary transferring step. The toner image transferred all at once is then fixed fast onto the recording medium by a fixing unit, thereby forming a color image.

Japanese Patent Laid-Open No. 2012-137733 discloses a configuration in which voltage is applied to a current supply member which contacts an intermediate transfer belt serving as an intermediate transfer medium. This aims to reduce costs and size of the image forming apparatus by doing away with a high-voltage power source dedicated to primary transfer. According to this configuration, current is supplied to multiple photosensitive drums in the peripheral direction of the intermediate transfer belt to perform primary transfer of the toner image onto the intermediate transfer belt. Also disclosed is a configuration where the intermediate transfer belt is connected to a stretching roller over which the intermediate transfer belt stretched via a voltage maintaining element (e.g., a Zener diode), to prevent attenuation of primary transfer voltage at each image forming station.

Also, there is known a configuration where correction control to correct relative position shifting of the toner images of each color, and correction control to correct change in toner density of each color, are periodically performed by detecting members detecting a test pattern formed on the surface of the intermediate transfer member. In Japanese Patent Laid-Open No. 2012-230250, a detecting member is disposed at an opposing position to the stretching roller.

However, disposing a detecting member at an opposing position to a stretching roller as described in Japanese Patent Laid-Open No. 2012-230250, in the configuration described in Japanese Patent Laid-Open No. 2012-137733, the following problem arises. That is to say, a Zener diode is connected at the stretching roller where the detecting member faces, so a predetermined potential is generated at a region on the intermediate transfer belt facing the detecting member. This potential may cause discharge between the stretching roller and detecting member, or floating toner to adhere to the intermediate transfer belt. These may cause deteriorated test pattern detection accuracy.

SUMMARY OF THE INVENTION

An image forming apparatus capable of reducing difference in potential between the starching roller and detecting member to suppress deterioration in detection accuracy due to the detecting member is disclosed.

An image forming apparatus includes: a plurality of image bearing members configured to bear toner images; an intermediate transfer belt configured to perform secondary transfer onto a transfer medium of a toner image subjected to primary transfer from the plurality of image bearing members, the intermediate transfer belt having been formed endless and rotatably; a current supply member configured to contact the intermediate transfer belt; a detecting member configured to detect a test pattern formed on the intermediate transfer belt; a contact member configured to contact an inner peripheral face of the intermediate transfer belt; a voltage maintaining element configured to be connected to the contact member; and an opposing member configured to oppose the detecting member across the intermediate transfer belt. The contact member to which the voltage maintaining element is connected maintains a predetermined potential by current flowing from the current supply member to the intermediate transfer belt. The opposing member contacts the inner peripheral face of the intermediate transfer belt at a different position from that of the contact member, and is in an electrically insulated state.

An image forming apparatus includes: a plurality of image bearing members configured to bear toner images; an intermediate transfer belt configured to perform secondary transfer onto a transfer medium of a toner image subjected to primary transfer from the plurality of image bearing members, the intermediate transfer belt having been formed endless and rotatably; a current supply member configured to contact the intermediate transfer belt; a detecting member configured to detect a test pattern formed on the intermediate transfer belt; and an opposing member configured to oppose the detecting member across the intermediate transfer belt. The opposing member is operable to switch between an electrically grounded state and a state connected to the voltage maintaining element. The contact member to which the voltage maintaining element is connected maintains a predetermined potential by current flowing from the current supply member to the intermediate transfer belt.

Further features of the present invention will become apparent from the following description of exemplary embodiments with reference to the attached drawings.

BRIEF DESCRIPTION OF THE DRAWINGS

FIG. 7A is a plan view illustrating the layout of the optical sensor and the intermediate transfer belt, and FIG. 7B is a side view of some members.

DESCRIPTION OF THE EMBODIMENTS

Embodiments relating to the present disclosure will be described in detail below, with reference to the attached diagrams. However, the dimensions, materials, shapes, relative layout, and so forth of components described in the embodiments herein are only examples and should be changed as appropriate depending on the configuration of an apparatus to which the present invention is to be applied to and various types of conditions. Accordingly, the descriptions of the embodiments are not intended to limit the scope of the present invention unless explicitly stated so.

First Embodiment

Figure 1:
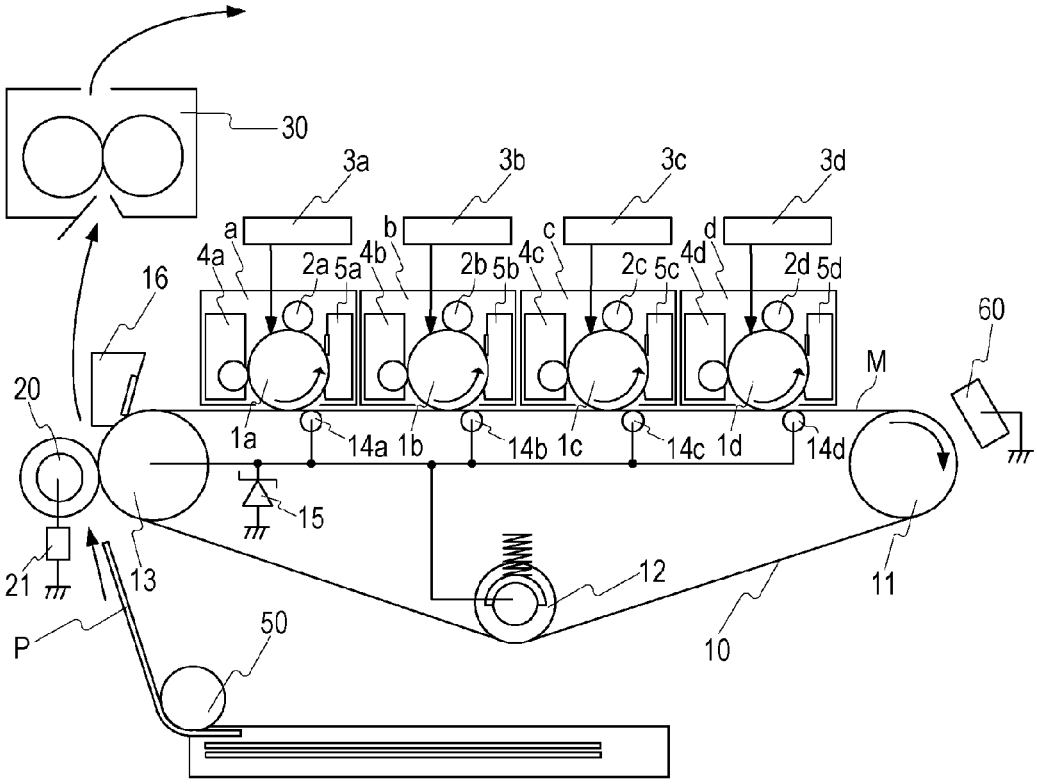
FIG. 1 is a diagram for describing an image forming apparatus according to a first embodiment.

FIG. 1 is a schematic diagram illustrating an example of a color image forming apparatus. The configuration and operations of the image forming apparatus according to a first embodiment will be described with reference to FIG. 1. Note that the image forming apparatus according to the present embodiment is a so-called tandem type printer where image forming stations "a" through d have been provided. A first image forming station "a" forms images of the color yellow (Y), a second image forming station b magenta (M), a third image forming station c cyan (C), and a fourth image forming station d black (Bk). These image forming stations are the same except for the color of toner accommodated therein. Hereinafter description will be made regarding the first image forming station "a".

The first image forming station "a" includes a drum-shaped electrophotography photosensitive member (hereinafter referred to as "photosensitive drum 1*a*"), a charging roller 2*a* which is a charging member, a developing unit 4*a*, and a cleaning device 5*a*. The photosensitive drum 1*a* is an image bearing member which bears a toner image, while being rotationally driven at a predetermined circumferential velocity (process speed) in the direction of the arrow in FIG. 1.

The developing unit 4*a* is a device which accommodates yellow toner, and develops yellow toner on the photosensitive drum 1*a*. The cleaning device 5*a* is a member which recovers toner which has adhered to the photosensitive drum 1*a*. The cleaning device 5*a* according to the present embodiment includes a cleaning blade which is a cleaning member contacting the photosensitive drum 1*a*, and a waste toner box to accommodate toner which the cleaning blade has recovered.

An image forming operation starts by a controller 274 receiving image signals, upon which the rotation driving of the photosensitive drum 1*a* starts. The photosensitive drum 1*a* is uniformly changed to a predetermined potential of a predetermined polarity (negative polarity in the present embodiment) by the charging roller 2*a*, in the process of rotating, and is exposed by an exposing unit 3*a* in accordance with the image signals. Thus, an electrostatic latent image according to the yellow component image of the intended color image is formed. Next, the electrostatic latent image is developed by the developing unit 4*a* (yellow developing unit) at a developing position, and visualized as a yellow toner image. Note that the proper charging polarity of the toner accommodated in the developing units is negative polarity. While reversal developing of the electrostatic latent image in the present embodiment is performed by toner charged by the charging member to the same polarity as the charging polarity of the photosensitive drum, the present invention can also be applied to an electrophotography apparatus which performs positive developing of the electrostatic latent image b toner charged to reverse polarity from the charging polarity of the photosensitive drum.

An intermediate transfer belt 10 is stretched over stretching rollers 11 and 12 serving as stretching members, and travels in the same direction in which the photosensitive drum 1*a* travels, at the opposing position where photosensitive drum 1*a* and the intermediate transfer belt 10 contact, at generally the same circumferential velocity as the photosensitive drum 1*a*. The yellow toner image formed upon the photosensitive drum 1*a* is transferred onto the intermediate transfer belt 10 (primary transfer) in the step of passing through the contact portion between the photosensitive drum 1*a* and the intermediate transfer belt 10 (hereinafter referred to as "primary transfer portion"). A current from a current supply member contacting the intermediate transfer belt 10 is applied in the peripheral direction of the intermediate transfer belt 10, so primary transfer potentials are formed at each primary transfer portion of the intermediate transfer belt 10. How the primary transfer potentials according to the present embodiment are formed will be described later.

Residual primary-transfer remaining toner on the surface of the photosensitive drum 1*a* is cleaned and removed by the cleaning device 5*a*, and then made available to the image formation process after charging.

In the same way, the second color magenta toner image, third color cyan toner image, and fourth color black toner image are formed by the second through fourth first image forming stations b through d, thereby forming a composited color image on the intermediate transfer belt 10, corresponding to the intended color image.

The four toner images on the intermediate transfer belt 10 are transferred all at once to the surface of a recording material P which is a transfer material, fed from a sheet feeding unit 50, in the step of passing through the secondary transfer portion formed between the intermediate transfer belt 10 and the secondary transfer member (secondary transfer). A secondary transfer roller 20 serving as the secondary transfer member is formed by covering a nickel plated steel bar, 8 mm in external diameter, with a foamed sponge so that the outer diameter of the secondary transfer roller 20 is 18 mm. The primary component of the foamed sponge is nitrile rubber (NBR) and epichlorohydrin rubber adjusted to volume resistivity of $10^8$ Ω·cm, and a thickness of 5 mm. The secondary transfer roller 20 presses against the outer peripheral face of the intermediate transfer belt 10 with a pressure of 50 N, thereby forming the secondary transfer portion. The secondary transfer roller 20 is rotated by the intermediate transfer belt 10, and is controlled by a transfer power supply 21 so as to carry a constant current while performing secondary transfer of the toner on the intermediate transfer belt 10 onto the recording material P.

The transfer power supply 21 is connected to the secondary transfer roller 20, and is configured to supply secondary transfer voltage output from a transformer, omitted from illustration, to the secondary transfer roller 20. A central processing unit (CPU) 276 (see FIG. 4) controls the secondary transfer voltage so that the secondary transfer current is generally constant, by giving feed back of a difference between a preset control current and a monitor current which is the actual output value. The transfer power supply 21 is capable of output in a range of 100 V to 4000 V.

Thereafter, the recording material P on which the four-color toner image has been transferred is guided to a fixing unit 30, and there is heated and pressurized, so that the toners of the four colors are fused and mixed, and thus fixed onto the recording material P. Any toner remaining on the intermediate transfer belt 10 after the secondary transfer is cleaned and removed by a cleaning device 16. Thus, a full-color printed image is formed by the above-described operations.

Next, the intermediate transfer belt 10, stretching members 11 through 13, and a voltage maintaining element, which are necessary to form the primary transfer potential at the primary transfer portion, will be described.

The intermediate transfer belt 10, serving as the intermediate transfer member, is situated at positions facing each of the image forming stations a through d. The intermediate transfer belt 10 is an endless belt which has been imparted with conductivity by adding a conducting agent to a resin material. The intermediate transfer belt 10 is stretched over the three stretching rollers of the driving roller 11, tension roller 12, and secondary transfer opposing roller 13, and is stretched by the tension roller 12 at a total tensile force of 60 N. The intermediate transfer belt 10 is driven by a driving source (omitted from illustration) so as to travel in the same direction in which the photosensitive drums 1*a* through 1*d* travel, at the opposing positions where the photosensitive drums 1*a* through 1*d* and the intermediate transfer belt 10 contact, at generally the same circumferential velocity as the photosensitive drums 1*a* through 1*d*. In the present embodiment, a primary transfer face (the face indicated by M in FIG. 1) to which the toner images are primary-transferred from the photosensitive drums 1*a* through 1*d* is formed by the two stretching members of the secondary transfer opposing roller 13 and the driving roller 11.

The intermediate transfer belt 10 used in the present embodiment has a circumferential length of 700 mm, a thickness of 90 μm, and is formed into an endless belt formed out of polyimide resin into which carbon has been mixed as a conducting agent. While polyimide resin has been described as the material of the intermediate transfer belt 10, other materials may be used as long as a thermoplastic resin. Examples include materials such as polyester, polycarbonate, polyacrylate, acrylonitrile-butadiene-styrene copolymer (ABS), polyphenylene sulfide (PPS), polyvinylidene fluoride (PVdF), or the like, and mixed resins thereof. Examples of conducting agents other than carbon which can be used include fine particles of conductive metal oxides and ion conductive agents.

The intermediate transfer belt 10 according to the present embodiment has volume resistivity of $1\times10^{9}$ Ω·cm. Measurement of the volume resistivity was performed using a Hiresta UP (MCP-HT450) manufactured by Mitsubishi Chemical Analytech Co, Ltd., with a type UR ring probe (Model MCP-HTP12). Measurement conditions were room temperature of 23° C. and room humidity of 50%, application voltage 100 V, and measurement time of 10 seconds. Volume resistivity in the range of $1\times10^{7}$ to $10^{10}$ Ω·cm is usable for the intermediate transfer belt 10 according to the present embodiment.

Volume resistivity is a measure of conductivity of the material of the intermediate transfer belt, and whether a desired primary transfer potential can be formed by actually applying current in the perimeter direction depends greatly on the magnitude of the resistance in the circumference direction.

Figure 2A:
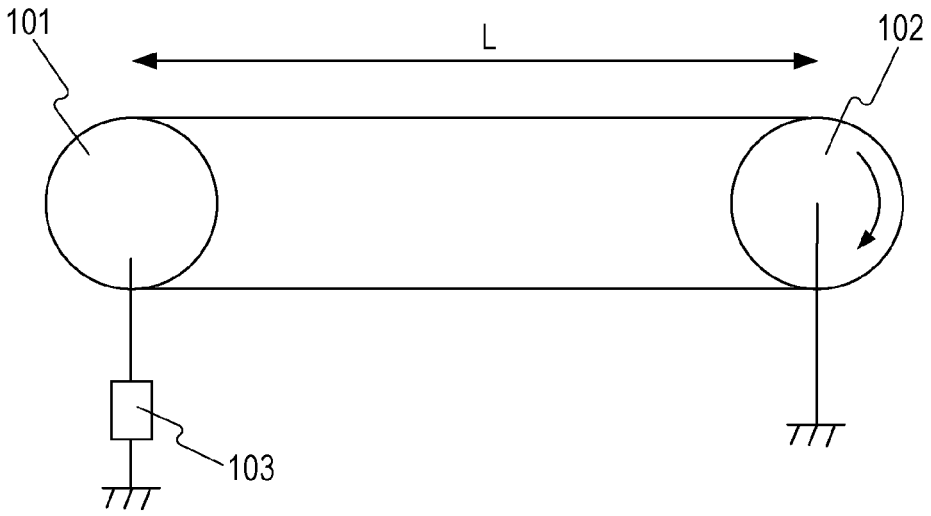
FIGS. 2A and 2B are diagrams representing a measurement system of intermediate transfer belt resistance in the peripheral direction, according to the first embodiment.

The resistance in the perimeter direction of the intermediate transfer belt 10 was measured using a jig illustrated in FIG. 2A. First, the configuration of the apparatus will be described. The intermediate transfer belt 10 to be measured is stretched by an inner peripheral surface roller 101 and driving roller 102 so that there is no slack. The inner peripheral surface roller 101 is formed of metal, and is connected to a high-voltage power supply (high-voltage power supply model 610E manufactured by TREK, INC) 103. The driving roller 102 is grounded. The surface of the driving roller 102 is covered by a conductive rubber with resistance sufficiently lower than that of the intermediate transfer belt 10, and the intermediate transfer belt 10 is turned so that the traveling speed thereof is 100 mm per second.

Next, the measurement method will be described. A constant current IL was applied to the inner peripheral surface roller 101 while the intermediate transfer belt 10 was being run at 100 mm per second by the driving roller 102, and voltage VL at the high-voltage power supply 103 connected to the inner peripheral surface roller 101 was monitored.

Figure 2B:
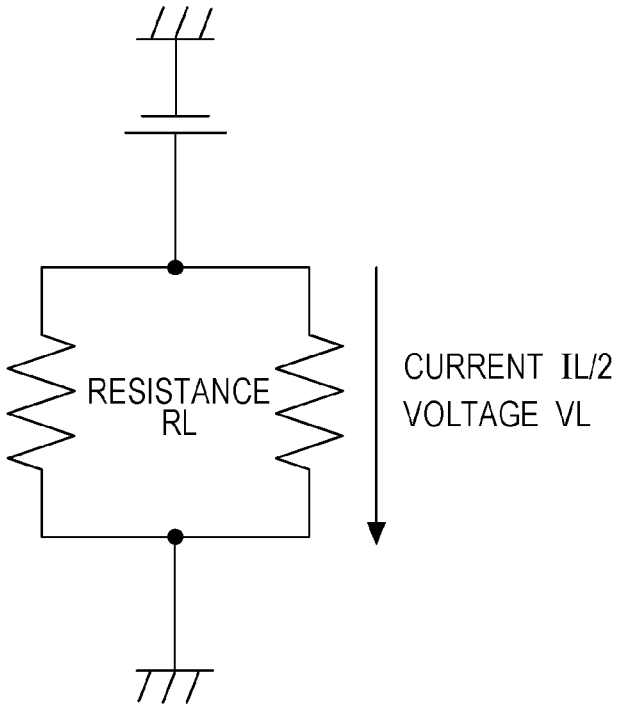

FIG. 2B can be understood to be an equivalent circuit of the measurement system illustrated in FIG. 2A. Resistance RL of the intermediate transfer belt 10 in the peripheral direction along the distance L from the inner peripheral surface roller 101 to the driving roller 102 (300 mm in the case of the present embodiment) can be calculated by RL=2 VL/IL. The resistance in the peripheral direction is then obtained by converting the resistance RL into peripheral length of the intermediate transfer belt 10 equivalent to 100 mm. Current is applied from the current supply member to the photosensitive drum 1 via the intermediate transfer belt 10, so the peripheral direction resistance is preferably $1\times10^{9}$ Ω·cm or lower.

The configuration according to the present embodiment uses the intermediate transfer belt 10 having the peripheral direction resistance value of $1\times10^{6}$ Ω·cm obtained by the above-described measurement method. The intermediate transfer belt 10 according to the present embodiment was measured at a constant current of IL=5 μA, which showed a monitor voltage VL at that time of 7.5 V. The monitor voltage VL is obtained by performing measurement over a section equivalent to one round of the intermediate transfer belt 10, and averaging the section measurement value. Since RL=2 VL/IL, then $RL=2\times7.5/(5\times10^{-6})=3.0\times10^{6}\Omega$, and converting this into an equivalent of 100 mm yields $1\times10^{6}$ Ω·cm. The present embodiment uses a conductive belt capable of carrying a current in the peripheral direction in this way as the intermediate transfer belt 10.

The secondary transfer opposing roller 13 (transfer opposing member) forming the primary transfer face of the intermediate transfer belt 10 is grounded via the voltage maintaining element. The voltage maintaining element is an element which maintains the potential of a connected member (the secondary transfer opposing roller 13) at a predetermined potential or higher, by current flowing from the voltage maintaining element to the voltage maintaining element via the intermediate transfer belt 10.

The predetermined potential of the voltage maintaining element has been set so as to maintain a primary transfer portion which can yield the desired transfer effects at the primary transfer portions. A Zener diode 15, which is a constant voltage element, is used as the voltage maintaining element in the present embodiment. The Zener diode 15 operates such that a predetermined voltage is generated at the cathode side when a predetermined or greater current flows therethrough (hereinafter "Zener voltage"). Zener voltage is set to 500 V in the present embodiment, to obtain the desired transfer effects.

Next, the method for forming the primary transfer potential to perform primary transferring will be described in detail.

In the configuration of the present embodiment, the transfer power supply 21 which serves as a transfer power supply that applies voltage to the secondary transfer member is used as a power supply to perform primary transfer. That is to say, the transfer power supply 21 is a transfer power supply used in both primary transfer and secondary transfer, and is a power supply which applies current to the primary transfer members, i.e., the secondary transfer roller 20 and intermediate transfer belt 10. The secondary transfer roller 20 is the current supplying member in the present embodiment. As described above, the secondary transfer opposing roller 13 is connected to the Zener diode 15, so the transfer power supply 21 performs primary transfer by applying current from the contact position toward the secondary transfer opposing roller 13 via the intermediate transfer belt 10 in this configuration. At this time, the potential of the secondary transfer opposing roller 13 corresponds to the Zener diode 15. This potential serves as the start point for current to be applied in the perimeter direction of the intermediate transfer belt 10, by which primary transfer potentials are formed at the image forming stations a through d. The toner on the photosensitive drums 1*a* through 1*d* moves onto the intermediate transfer belt 10 by the potential difference between this primary transfer potential and the photosensitive drum potential, thus performing primary transfer.

Figure 3:
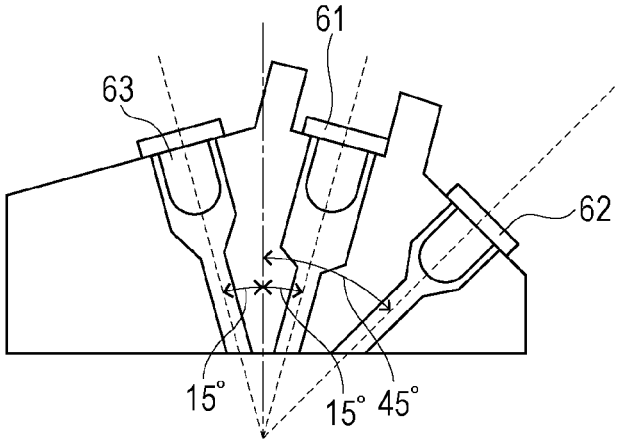
FIG. 3 is a cross-sectional diagram of an optical sensor according to the first embodiment.

Next, description will be made regarding an optical sensor 60 which is the detecting member, controller operations, density control, and registration control. FIG. 3 is a cross-sectional view illustrating the optical sensor 60. The optical sensor 60 includes a light emitting element 61 such as an LED or the like, serving as a light emitting portion which emits light to the intermediate transfer belt 10, a light receiving elements 62 and 63 such as phototransistors serving as light receiving members to receive reflected light, and a holder. The light emitting element 61 is disposed so as to have an inclination of 15° to the intermediate transfer belt 10. The light emitting element 61 irradiates a test patch on the intermediate transfer belt 10 or the surface of the intermediate transfer belt 10 with infrared light (e.g., wavelength of 950 nm). The light receiving element 62 is disposed having an inclination of 45° to the intermediate transfer belt 10, and receives infrared light diffusely-reflected from the test patch or the surface of the intermediate transfer belt 10. The light receiving element 63 is disposed having an inclination of 15° to the intermediate transfer belt 10, and primarily receives the normal reflection component of the infrared light from the test pattern or the surface of the intermediate transfer belt 10. The optical sensor 60 obtains information of a toner patch formed by toner transferred onto from the photosensitive drums onto the intermediate transfer belt 10 at a timing different from normal image forming period, as a test pattern.

There are different types of toner patches, such as a registration control patch to detect the amount of position shift between the relative positions of developers of different colors, and a density control patch.

Figure 4:
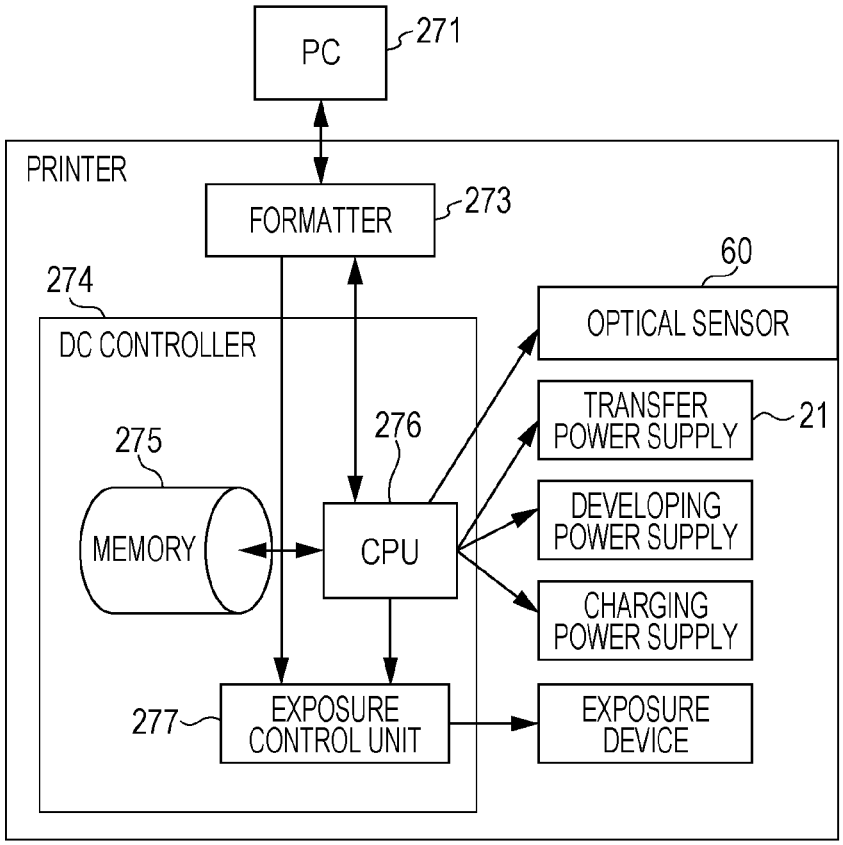
FIG. 4 is a block diagram for describing operations of the image forming apparatus according to the first embodiment.

Next, controller operations will be described. FIG. 4 is a block diagram illustrating controller operations. A PC 271 which is a host computer outputs printing commands to a formatter 273 the image forming apparatus or printer, and serves the role of transferring image data of the image to be printed to the formatter 273. The formatter 273 converts the image data from the PC 271 into exposure data, and transfers to an exposure control unit 277 within a DC controller 274. The exposure control unit 277 performs on/off control of an exposure device under control of the CPU 276. The CPU 276 starts the image forming sequence upon receiving the print command.

The DC controller 274 includes the CPU 276, memory 275, and so forth, and performs preprogrammed operations. The CPU 276 controls a charging power supply, developing power supply, and transfer power supply 21 so as to control the image forming step in which the exposure data is transferred onto the recording material as a toner image. The CPU 276 also performs processing of receiving signals from the optical sensor 60 when calibrating. When performing calibration, a test patch is formed on the intermediate transfer belt 10 and the amount of reflected light from the test patch is measured. Light signals from the test patch that have been received at the light receiving element 63 are subjected to AD conversion by way of the CPU 276, and then stored in the memory 275. The optical sensor 60 does not operate during a normal printing sequence, but operates during registration control and when performing calibration such as density control and so forth.

Figure 5A:
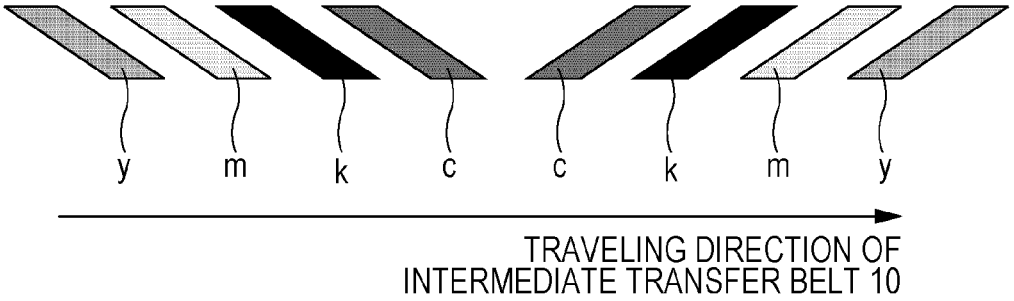
FIGS. 5A and 5B are diagrams illustrating test patterns according to the first embodiment.

Next, the calibration operations will be described. Specialized toner patches are formed for each of registration control and density control. FIG. 5A illustrates an example of a toner patch formed for registration control, which is a pattern of solid patches of each color, formed as parallelograms tilted in opposite directions. During registration control, reflected light from the intermediate transfer belt 10 and the test pattern is detected by the light receiving element 63. The light receiving element 63 primarily detects normal reflection light, so the output thereof is low when detecting a toner image of which the reflected light is primarily diffused light, and the output thereof is high when detecting the intermediate transfer belt 10 of which the reflected light is primarily normal reflection light. Accordingly, the rising and falling of output can be detected when detecting each patch, enabling the edges of each patch to be identified, so the center of gravity of each patch can be calculated from the leading and trailing edges. The relative position of each color (the amount of shift among toner images of different colors) is calculated from the center of gravity position of each patch obtained by this method, with yellow as a reference, and registration correction is performed.

Figure 5B:
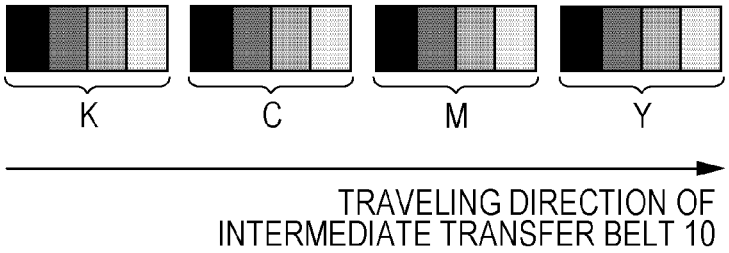

FIG. 5B illustrates an example of a toner patch formed for density control, including patches of several tones for each color. This toner patch is a toner pattern for calculating a measurement amount having correlation with toner amount. The light receiving element 62 and light receiving element 63 receive the reflected light from each of the patches and from the intermediate transfer belt 10. The light receiving element 62 receives some diffused reflection light, so the net normal reflection output is obtained by obtaining the difference between the detection output of the light receiving element 63 and the detection output of the light receiving element 62. The net normal reflection output corresponds to the toner density on a one-to-one relation, so density correction can be performed based on the light reception results.

A feature configuration of the present embodiment will be described. The present embodiment includes metal rollers 14*a* through 14*d* serving as contact members contacting the intermediate transfer belt 10. The metal rollers 14*a* through 14*d* are disposed with a predetermined amount of offset near positions corresponding to the photosensitive drums 1*a* through 1*d*, across the intermediate transfer belt 10. The tension roller 12 and secondary transfer opposing roller 13 which stretch the intermediate transfer belt 10, and the metal rollers 14*a* through 14*d*, are connected to the Zener diode 15. The driving roller 11 opposing the optical sensor 60 is in an electrically floating state (insulated state). This will be described in further detail.

Figure 6:
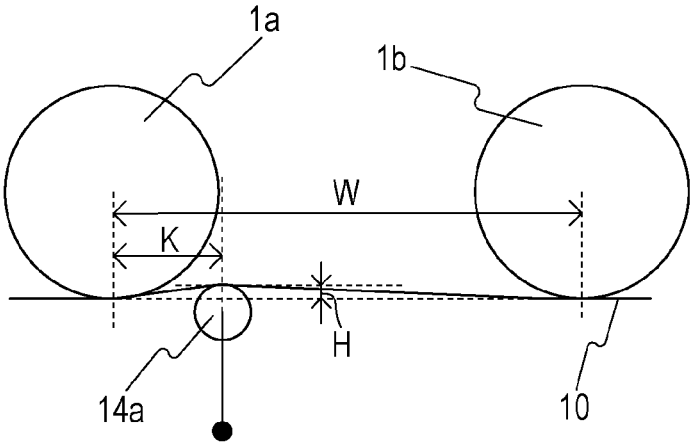
FIG. 6 is a diagram illustrating the configuration of a metal roller according to the first embodiment.

First, the configuration of the metal rollers will be described in detail with reference to FIG. 6. FIG. 6 is an enlargement of part of the configuration illustrated in FIG. 1. In FIG. 6, the metal roller 14*a* is offset 8 mm downstream in the direction of travel of the intermediate transfer belt 10 from the center position of the photosensitive drum 1*a*. The metal roller 14*a* is also positioned 1 mm higher than a horizontal plane formed between the photosensitive drum 1*a* and the intermediate transfer belt 10, so that a certain amount of wrapping of the intermediate transfer belt 10 onto the photosensitive drum 1*a* can be ensured.

The above-described metal rollers 14*a* through 14*d* are disposed as close as possible to the photosensitive drums 1*a* through 1*d* without contact therewith, so as to stabilize the primary transfer potential. The reason why the metal rollers 14*a* through 14*d* are disposed downstream in the traveling direction of the intermediate transfer belt 10 is that this arrangement is advantageous with regard the phenomena of scattering which occurs on the upstream side of the primary transfer nip due to a transfer electric field being formed.

In FIG. 6, W represents the distance between the photosensitive drum 1*a* of the first image forming station "a" and the photosensitive drum 1*b* of the second image forming station b, K represents the offset distance of the metal roller 14*a*, and H represents the raised height of the metal roller 14*a* to the intermediate transfer belt 10. The values W=60 mm, K=8 mm, and H=1 mm are used in the present embodiment. The metal roller 14*a* is formed of a straight round rod of nickel-plated stainless steel having an outer diameter of 6 mm, which is rotated by the intermediate transfer belt 10 turning. The metal roller 14*b* disposed at the second image forming station b, the metal roller 14*c* disposed at the third image forming station c, and the metal roller 14*d* disposed at the fourth image forming station d, are formed in the same way as the metal roller 14*a* disposed at the first image forming station "a". The tension roller 12 and secondary transfer opposing roller 13 which stretch the intermediate transfer belt 10, and the metal rollers 14*a* through 14*d*, are grounded via the Zener diode 15. The driving roller 11 in an electrically floating state.

The configuration according to the present embodiment performs primary transfer by using the transfer power supply 21 to apply current to the secondary transfer opposing roller 13 connected to the Zener diode 15 via the intermediate transfer belt 10, thereby supplying current to the metal rollers 14*a* through 14*d*.

Next, primary transfer will be described in detail. The rollers 12 and 13 which stretch the intermediate transfer belt 10, and the metal rollers 14*a* through 14*d*, are grounded via the Zener diode 15, under voltage output from the transfer power supply 21. Accordingly, voltage of a value corresponding to the Zener diode 15 (500 V in this case) is output to the rollers. Since the metal rollers 14*a* through 14*d* are maintained at 500 V, the potential of the intermediate transfer belt 10 near the photosensitive drums 1*a* through 1*d* can also be maintained. Consequently, dropping of primary transfer potential due to current flowing in the perimeter direction of the intermediate transfer belt 10 can be minimized, and primary transfer potential suitable for performing primary transfer can be maintained at the image forming stations a through d.

Figure 7A:
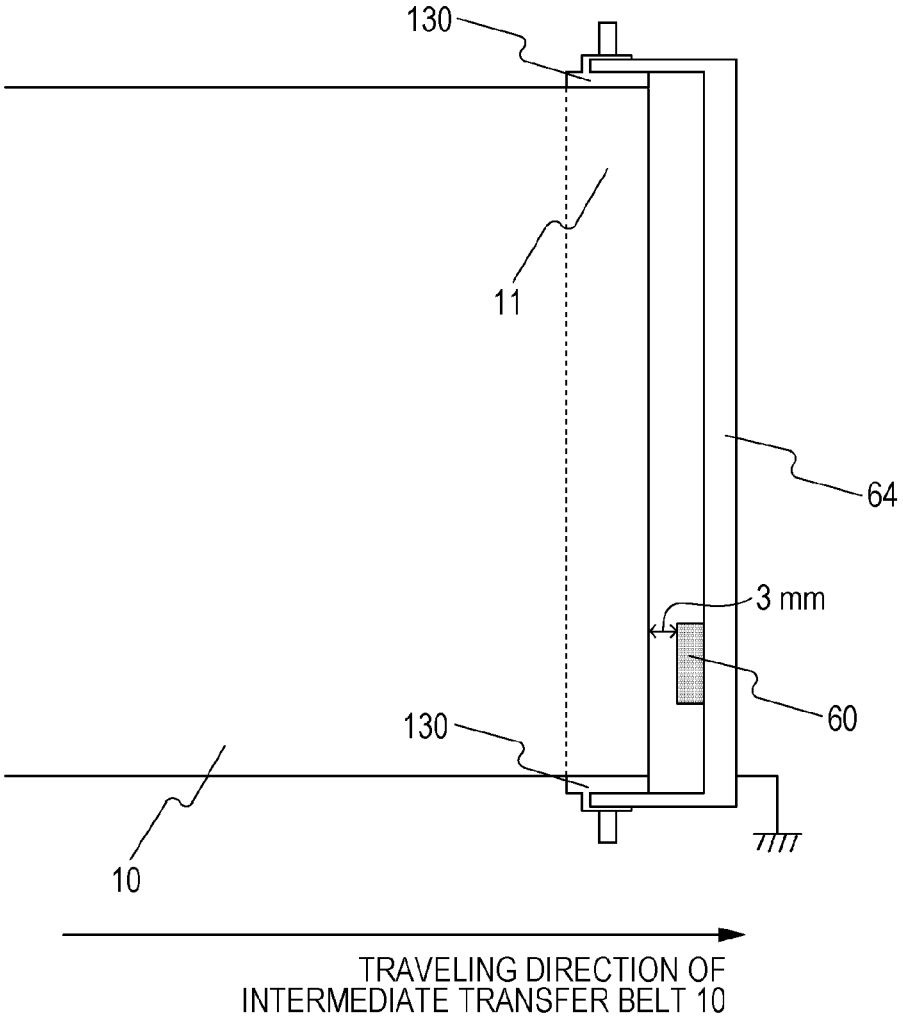
FIGS. 7A and 7B are diagrams illustrating an optical sensor and other nearby members according to the first embodiment, where

Next, the placement of the optical sensor 60 will be described in detail. FIG. 7A is a plan view illustrating the way in which the optical sensor 60 is attached to an intermediate transfer belt unit.

The optical sensor 60 is disposed opposing the driving roller 11. The distance between the surface of the intermediate transfer belt 10 and a holder of the optical sensor 60 is 3 mm. The optical sensor 60 is fixed to a supporting plate 64 in this configuration, to stabilize the positional relation between the intermediate transfer belt 10 and the optical sensor 60. The distance between the intermediate transfer belt 10 and the optical sensor 60 needs to be maintained at a constant to obtain reflected light from the intermediate transfer belt 10 and test patterns in stable manner. In the present embodiment, the supporting plate 64 is fixed to a bearing of the driving roller 11, so as to follow positional change of the driving roller 11.

Figure 7B:
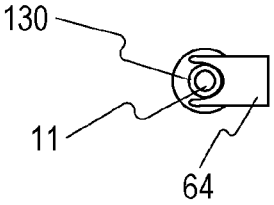

This configuration enables the distance between the intermediate transfer belt 10 and the optical sensor 60 to be stabilized. Also, the supporting plate 64 is grounded to the housing of the image forming apparatus, to prevent interference which occurs due to radiant electromagnetic waves from the supporting plate 64. Accordingly, the driving roller 11 and the supporting plate 64 need to be electrically insulated, so the supporting plate 64 is attached to the driving roller 11 via an insulated bearing 130 (see FIG. 7B).

Next, the operations of the present embodiment will be described. First, primary transfer performance according to the present embodiment will be described.

Figure 8:
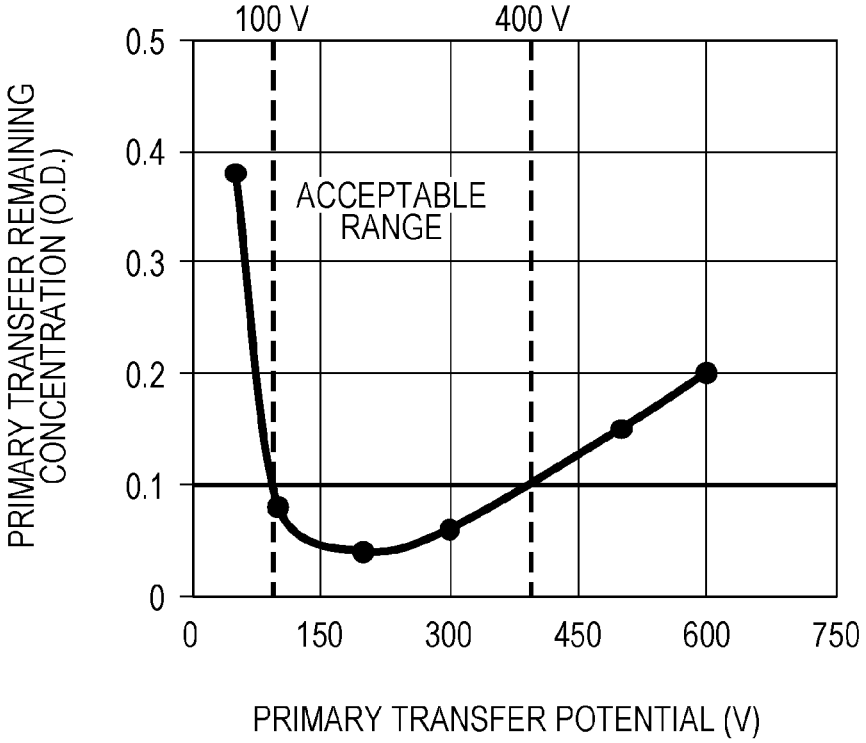
FIG. 8 is a diagram illustrating the relationship between primary transfer potential and primary transfer efficiency according to the first embodiment.

FIG. 8 is a graph illustrating the relation between primary transfer potential and primary transfer efficiency. The vertical axis represents the transfer efficiency. The transfer efficiency values are indicated by the results of primary transfer remaining density measured by a Macbeth densitometer (manufactured by GretagMacbeth). The greater the value is, the greater the primary transfer remaining concentration is, so the poorer the transfer efficiency is. It can be seen from the graph in FIG. 8 that the relation between the primary transfer potential and primary transfer efficiency requires primary transfer potential of 100 to 400 V.

The configuration of the present embodiment thus enables current to be directly supplied from the metal rollers 14*a* through 14*d* disposed nearby the image forming stations. As a result, dropping of primary transfer potential due to current flowing in the perimeter direction of the intermediate transfer belt 10 can be minimized. Thus, primary transfer potential suitable for performing primary transfer can be maintained, and good primary transfer performance can be ensured. Further, electricity can be supplied from positions close to the photosensitive drums 1*a* through 1*d*, so regions of the intermediate transfer belt 10 with high resistance can also be employed. This serves to suppress scattering which occurs in cases where the resistance of the intermediate transfer belt 10 is low.

The primary transfer potential is formed by the Zener diode 15 in the configuration of the present embodiment, so the primary transfer potential is a fixed value even if the usage environment changes, such as change in temperature and humidity, thickness of the photosensitive drum film, and so forth. When the usage environment changes, the potentials at the photosensitive drums 1*a* through 1*d* change, so if the primary transfer potential is fixed the transfer contrast changes. Now, the potentials of the photosensitive drums 1*a* through 1*d* can be stabilized by changing the voltage values of the charging rollers 2*a* through 2*d* in accordance with change in the usage environment, thus maintaining suitable primary transfer contrast. Another method is to uniformly expose the surfaces of the photosensitive drums 1*a* through 1*d* by weak exposure light at the time of the exposing units 3*a* through 3*d* forming electrostatic latent image corresponding to the image signals; this method may be used to stabilize the photosensitive drum potential.

Next, potential generated at the driving roller 11, which is a roller opposing the sensor, will be described. When performing calibration, voltage of +500 V is applied to the metal rollers 14 by the operation of the Zener diode 15 to form the test pattern, and accordingly current flows from the metal rollers 14 to the photosensitive drums 1 via the intermediate transfer belt 10. This flowing of current attenuates the potential on the intermediate transfer belt 10, so the potential at the primary transfer portions is +400 V. Further, a part of positive-polarity charge supplied from the metal rollers 14 dwells on the inner peripheral surface of the intermediate transfer belt 10, so the intermediate transfer belt 10 is positively charged and has potential. On the other hand, the driving roller 11 is in an electrically floating state, so the potential of the driving roller 11 becomes the same potential as that of the intermediate transfer belt 10. Part of the potential supplied from the metal rollers 14 flows into the photosensitive drums 1, causing attenuation of the potential on the intermediate transfer belt 10, so by the time of reaching the driving roller 11 the potential is +350 V. This means that the potential of the driving roller 11 also is +350 V, and accordingly the potential difference between the driving roller 11 and the optical sensor 60 is 80 V lower than the arrangement where the driving roller 11 is connected via a Zener diode. While the potential is +500 V when connected by the same Zener diode as that of the secondary transfer opposing roller 13, the potential in the present embodiment where the driving roller 11 is in an electrically floating state is attenuated to +350 V. The threshold for occurrence of discharge due to potential difference between the driving roller 11 and optical sensor 60 is 500 V. The potential difference in the present embodiment is smaller than this, so disturbance in the toner patch due to discharge can be prevented.

The smaller the potential difference between the supporting plate 64 of the optical sensor 60 and the intermediate transfer belt 10 is, the weaker the electrostatic force electrically drawing floating toner within the image forming apparatus to the intermediate transfer belt 10 is. Having the potential of the driving roller 11 at +350 V makes toner adhesion to the intermediate transfer belt 10 less ready to occur. Thus, discharge and adhesion of floating toner can be prevented according to the configuration according to the present embodiment, so disturbance of the toner patch can be prevented, and stable toner patch detection can be realized.

Next, the operations of the present embodiment will be described by way of comparative examples. Table 1 illustrates measurement results of primary transfer potential and driving roller potential in the black stations of the present embodiment and comparative examples.

TABLE 1

| First Embodiment | | Comparative Example 1 | | Comparative Example 2 | |
|---|---|---|---|---|---|
| Primary transfer potential | Potential difference | Primary transfer potential | Potential difference | Primary transfer potential | Potential difference |
| 400 V | 350 V | 200 V | 500 V | 80 V | 0 V |

Figure 9:
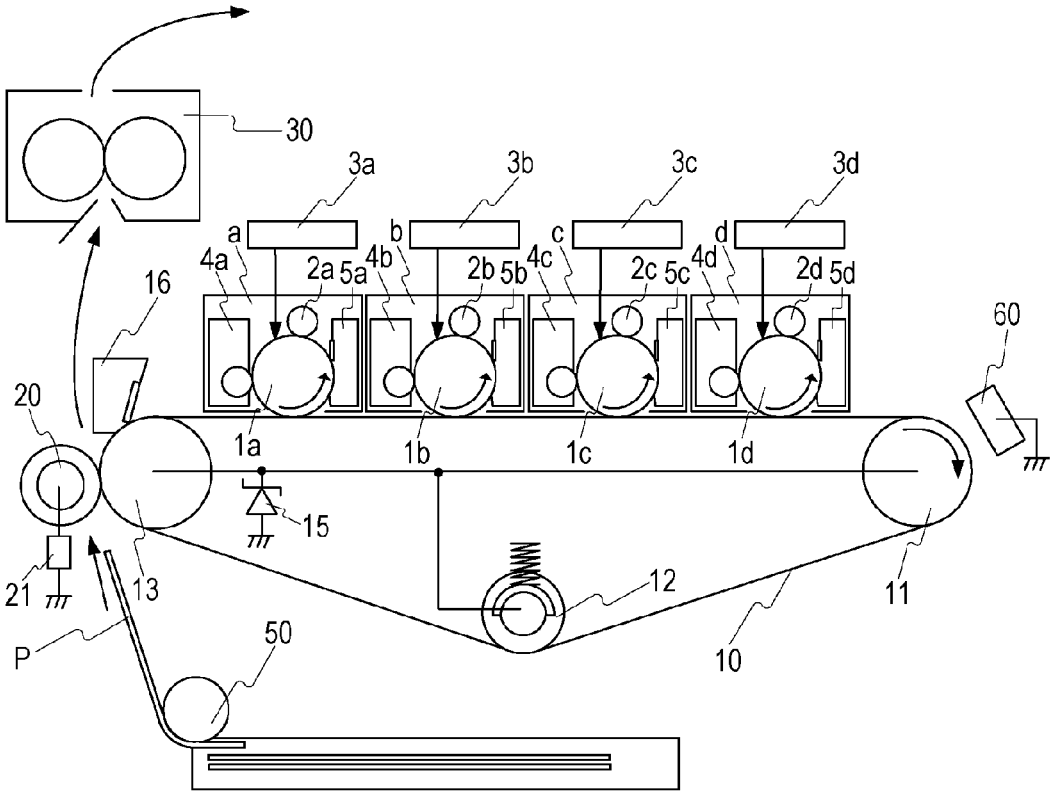
FIG. 9 is a schematic configuration diagram of an image forming apparatus according to a comparative example 1 in the first embodiment.
Figure 10:
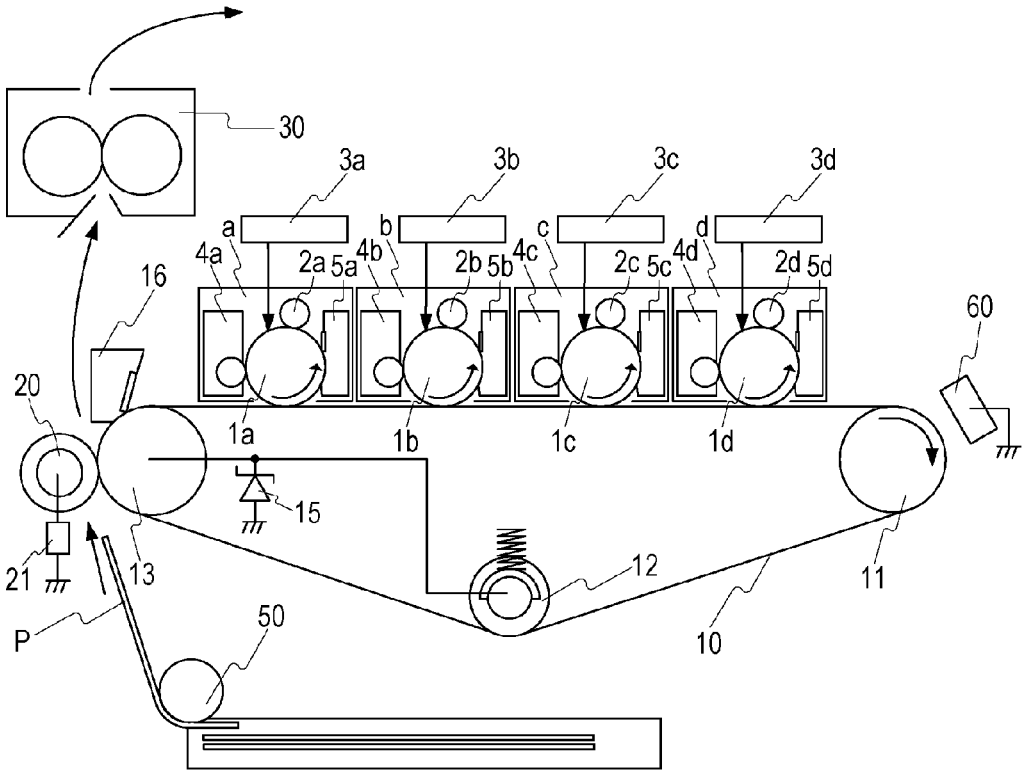
FIG. 10 is a schematic configuration diagram of an image forming apparatus according to a comparative example 2 in the first embodiment.

The comparative example 1 is an arrangement where the optical sensor 60 is disposed at the opposing position of the driving roller 11 in the configuration in Japanese Patent Laid-Open No. 2012-230250. The comparative example 2 is an arrangement where the driving roller 11 is grounded, and the optical sensor 60 is disposed at the opposing position in the configuration in Japanese Patent Laid-Open No. 2012-230250. FIGS. 9 and 10 are schematic configuration diagrams of the comparative examples 1 and 2, respectively.

The configuration according to the present embodiment where metal roller 14*d* is disposed and connected to the secondary transfer opposing roller 13 by the Zener diode 15 operates such that the primary transfer potential is +400 V, and the potential at the driving roller 11 is +350 V. As a result, good primary transfer efficiency was secured, and no toner patch disturbance occurred. On the other hand, the comparative example 1 is configured such that the secondary transfer opposing roller 13 and driving roller 11 are connected by the Zener diode 15, which is an arrangement in which the distance between the black station and the driving roller 11 is longer as compared to the distance between the black station and the metal roller 14*d* in the first embodiment, i.e., the distance between the black station and the roller supplied with current is longer in the comparative example 1. Accordingly, the primary transfer potential of the comparative example 1 was attenuated to +200 V. While this is lower than that in the first embodiment, good primary transfer efficiency was still secured. However, the potential at the driving roller 11 was +500 V, and instances where observed where toner patches were disturbed due to discharge occurring between the optical sensor 60 and supporting plate 64, and adhesion of floating toner to the intermediate transfer belt 10. On the other hand, the potential at the driving roller 11 in the comparative example 2 was 0 V, so there was no disturbance of the toner patches, but the primary transfer potential was attenuated to +80 V as a result of current flowing to the driving roller 11, so good primary transfer efficiency could not be secured.

As described above, according to the configuration of the present embodiment, good primary transfer efficiency can be secured, discharge occurring between the intermediate transfer belt 10 and the supporting plate 64 of the optical sensor 60 and adhesion of floating toner to the intermediate transfer belt 10 can be prevented, thereby suppressing disturbance in test patterns.

While the potential difference as to the supporting plate 64 of the optical sensor 60 has been described as being +350 V by placing the driving roller 11 in an electrically floating state in the present embodiment, potential difference of 500 V or lower is sufficient to suppress occurrence of discharge. The potential difference is preferably +400 V or lower to prevent adhesion of floating toner to the intermediate transfer belt 10.

The present embodiment is not restricted to using a Zener diode as the voltage maintaining element. Any other element such as a varistor may be used as long as similar results can be obtained.

While the present embodiment has been described as using a secondary transfer roller 20 as a current supplying member, a member other than the secondary transfer roller 20 may be used as the current supplying member. For example, voltage may be applied to the cleaning blade of the cleaning device 16, so as to use the cleaning blade as the current supplying member.

Figure 11A:
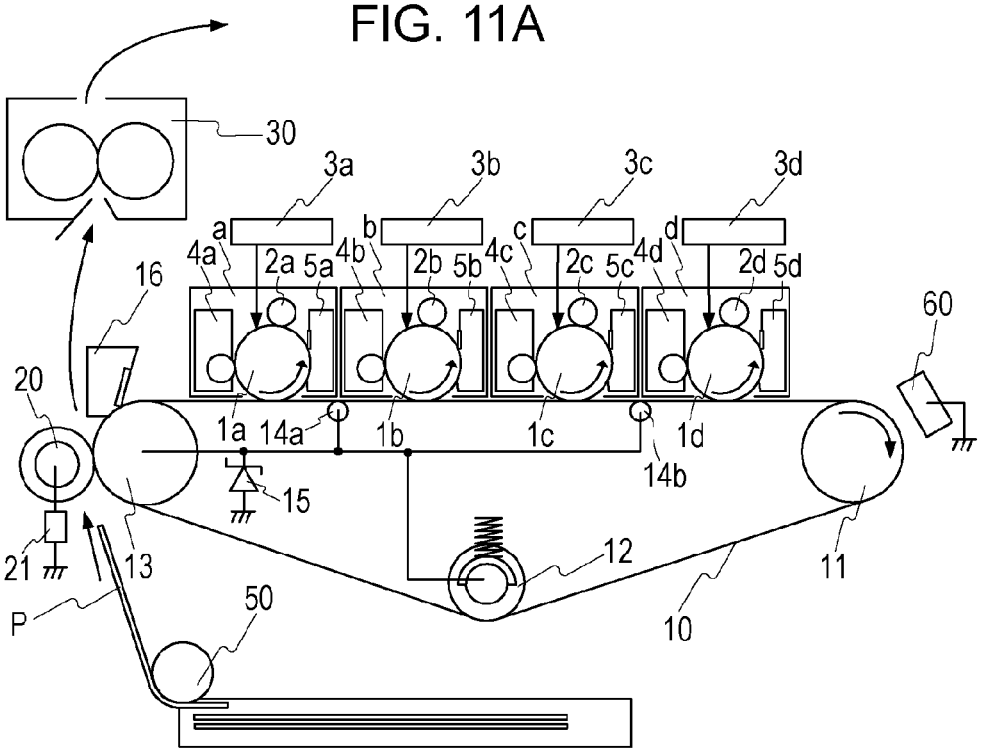
FIGS. 11A and 11B are schematic configuration diagrams of other configurations of the image forming apparatus according to the first embodiment.
Figure 11B:
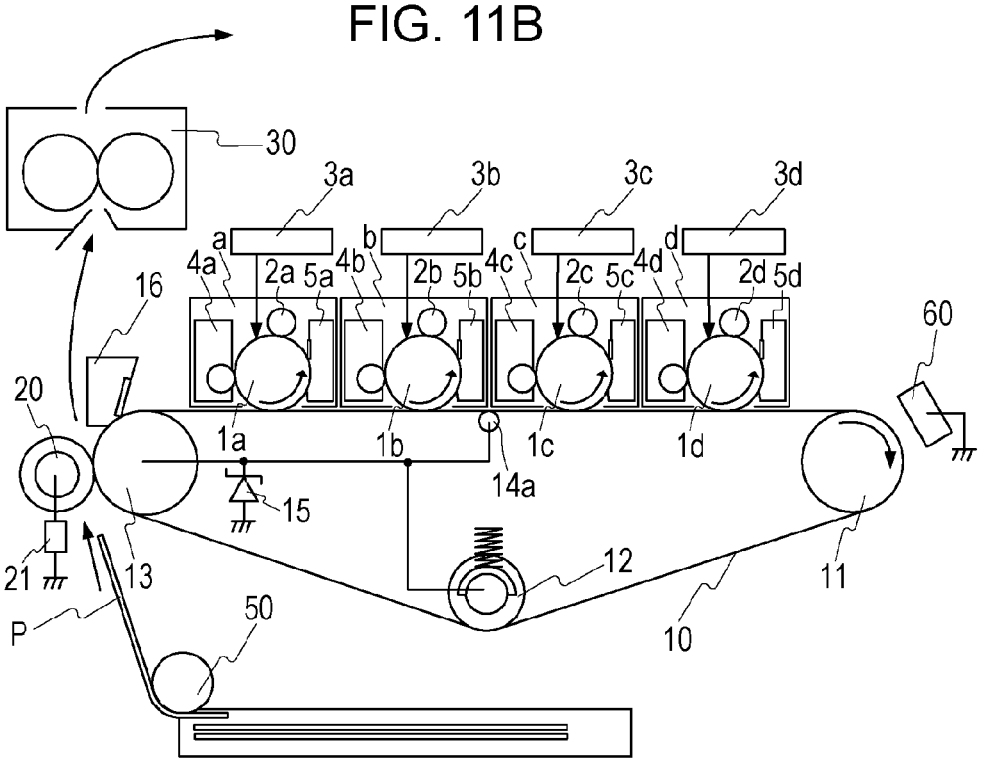

Also, while the present embodiment has been described has having a total of four metal rollers 14 disposed, each facing a respective image forming station, the number of metal rollers 14 is not restricted to four. Fewer metal rollers 14 than four may be used if good primary transfer performance can be obtained. For example, an arrangement may be made such as illustrated in FIG. 11A, where one metal roller 14*a* is disposed between the yellow and magenta stations, and one metal roller 14*b* is disposed between the cyan and black stations. Alternatively, an arrangement may be made such as illustrated in FIG. 11B, where a single metal roller 14*a* is disposed between the magenta and cyan stations.

Second Embodiment

The first embodiment suppresses change in potential at the primary transfer portions and enables stable detection of test patterns by connecting the voltage maintaining element to the metal rollers 14, and electrically floating the driving roller 11 at the opposing position of the optical sensor 60. On the other hand, in a second embodiment, the voltage maintaining element is connected to the secondary transfer opposing roller 13 and driving roller 11, and the optical sensor 60 is set opposing a stretching roller other than the secondary transfer opposing roller 13 and driving roller 11, i.e., the tension roller 12 in the present embodiment. Other configurations are the same as those of the image forming apparatus according to the first embodiment, so the same parts are denoted by the same reference numerals in the following description.

Figure 12:
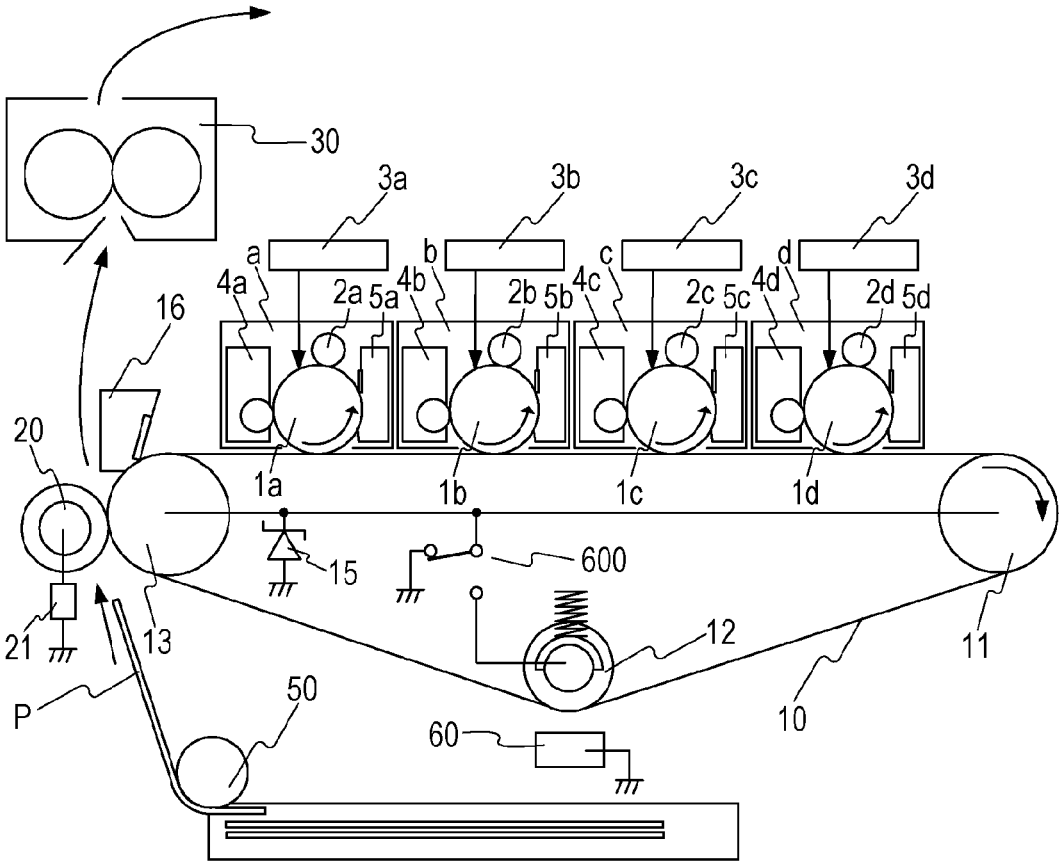
FIG. 12 is a diagram for describing an image forming apparatus according to a second embodiment.

FIG. 12 is a schematic configuration diagram of the image forming apparatus according to the present embodiment. The optical sensor 60 is disposed facing the tension roller 12, and the tension roller 12 is configured so as to be capable of being switched between being connected to the Zener diode 15 serving as the voltage maintaining element, and being grounded, by a switching circuit 600.

The same calibration pattern as that used in the first embodiment is used in the second embodiment as well. The registration control toner patch and density control toner patch are separated, to ground the tension roller 12 during toner patch detection.

Figure 13:
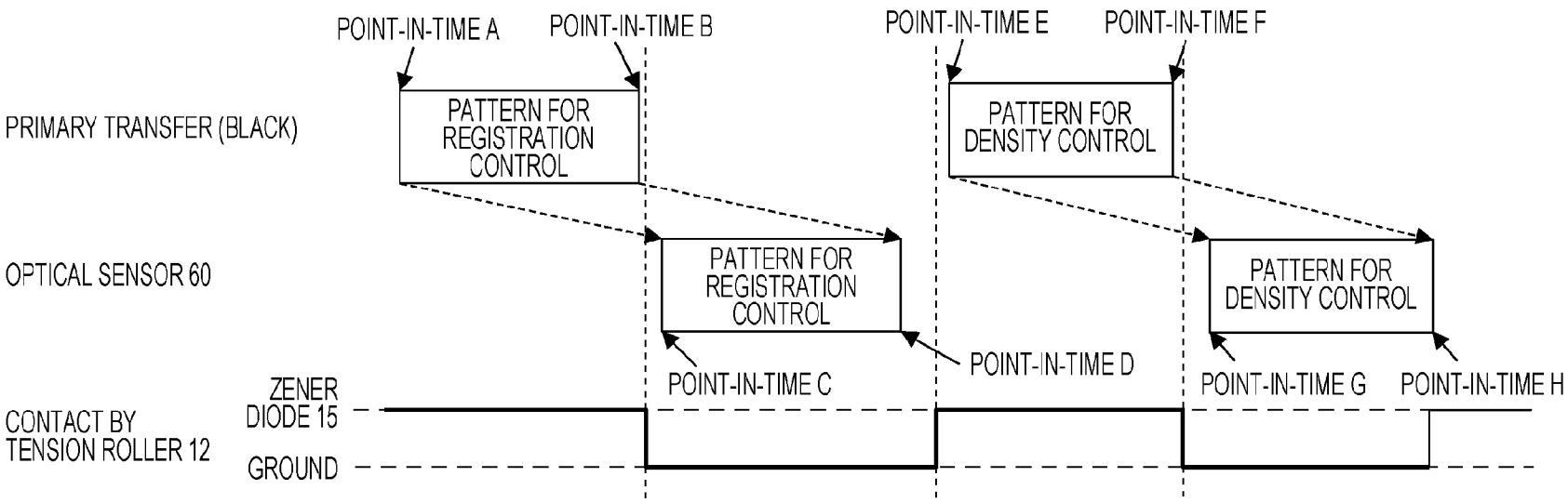
FIG. 13 is a diagram illustrating a timing chart according to the second embodiment.

Next, the operations of the present embodiment will be described. FIG. 13 is a timing chart illustrating timing of a toner patch according to the present embodiment passing the primary transfer portion of the fourth image forming station d, the timing of passing the optical sensor 60, and the tension roller 12 being connected to the Zener diode 15 or grounded. First, at the timing of point-in-time A, the leading edge of the registration control toner path passes the primary transfer portion of the fourth image forming station d. At this time, the registration control toner patch is being primary-transferred at the image forming stations of each color, so the tension roller 12 is connected to the Zener diode 15.

Next, the trailing edge of the registration control toner patch passes the fourth image forming station d at the timing of point-in-time B. The timing at which the leading edge of the registration control toner patch reaches the position of the optical sensor 60 is point-in-time C. The tension roller 12 is switched to an electrically grounded state at a timing between point-in-time B and point-in-time C. Next, the timing of point-in-time D is a timing at which the trailing edge of the registration control toner patch passes the optical sensor 60. The registration control toner patch which has passed the optical sensor 60 is cleaned and removed by the cleaning device 16. Following the registration control toner patch, the leading edge of the density control toner patch passes the primary transfer portion of the fourth image forming station d at the timing of point-in-time E. The tension roller 12 is connected to the Zener diode 15 at a timing between point-in-time D and point-in-time E. The trailing edge of the primary-transferred density control toner patch passes the primary transfer portion of the fourth image forming station at the timing of point-in-time F, and the tension roller 12 is grounded by the timing of point-in-time G at which the leading edge passes the optical sensor 60. The tension roller 12 is further switched to connect to the Zener diode 15 at the timing of point-in-time H where the trailing edge of the density control toner patch passes the optical sensor 60. The density control toner patch detected at the optical sensor 60 is cleaned and removed by the cleaning device 16, and the calibration operation ends.

The advantages of the present embodiment will be described. The Zener diode 15 according to the present embodiment is connected to the driving roller 11, tension roller 12, and secondary transfer opposing roller 13 during primary transfer, so primary transfer potential is not attenuated, and good primary transfer efficiency can be ensured. Also, grounding the tension roller 12 at the opposition position of the optical sensor 60 while detecting the test pattern sets the potential at the optical sensor 60 and the tension roller 12 both to zero, so there is no potential difference. This prevents discharge and adhesion of floating toner to the intermediate transfer belt 10, and does away with disturbance in the test pattern, so good test pattern detection accuracy can be ensured.

According to the present embodiment as described above, attenuation of primary transfer potential during primary transferring can be suppressed, and the potential difference between the tension roller 12 and the optical sensor 60 can be made to be zero while detecting test patterns, so stable test pattern detection can be realized.

Note that while the registration control test pattern and density control test pattern have been divided in the present embodiment, but these do not need to be divided of the total length thereof will fit within the distance between the black primary transfer position and the tension roller 12.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-211273, filed Oct. 8, 2013, which is hereby incorporated by reference herein in its entirety.

What is claimed is:

1. An image forming apparatus comprising:

a plurality of image bearing members configured to bear toner images:

an intermediate transfer belt configured to perform secondary transfer onto a transfer medium of a toner image subjected to primary transfer from the plurality of image bearing members, the intermediate transfer belt having been formed endless and rotatably;

a current supply member configured to contact the intermediate transfer belt;

a detecting member configured to detect a test pattern formed on the intermediate transfer belt;

a contact member configured to contact an inner peripheral face of the intermediate transfer belt;

a voltage maintaining element configured to be connected to the contact member; and an opposing member configured to oppose the detecting member across the intermediate transfer belt;

a bearing configured to support a shaft of an opposing roller serving as the opposing member, the opposing roller being rotated by the intermediate transfer belt, the bearing being electrically insulated; and a supporting plate configured to support the detecting member, wherein the supporting plate is supported by the bearing, wherein the contact member to which the voltage maintaining element is connected maintains a predetermined potential by current flowing from the current supply member to the intermediate transfer belt; and wherein the opposing member contacts the inner peripheral face of the intermediate transfer belt at a different position from that of the contact member, and is in an electrically insulated state.

2. The image forming apparatus according to claim 1, wherein the intermediate transfer belt is a belt having conductivity enabling current to flowing from the a contact position of the current supply member where the current supply member contacts the intermediate transfer belt in the a peripheral direction of the intermediate transfer belt, to the plurality of image bearing members, through the intermediate transfer belt.

3. The image forming apparatus according to claim 1, further comprising:

a power supply configured to apply voltage to the current supply member;

wherein the power supply applies current to the plurality of image bearing members from the current supply member via the intermediate transfer belt by applying voltage to the current supply member voltage to the current supply member to cause current to flow from the current supply member to the plurality of image bearing members through the intermediate transfer belt, thereby effecting primary transfer of the toner images from the plurality of image bearing members to the intermediate transfer belt.

4. The image forming apparatus according to claim 3, wherein the current supply member forms a secondary transfer portion by contacting the an outer peripheral face of the intermediate transfer belt, and performs secondary transfer of the toner image from the intermediate transfer belt to the transfer material at the secondary transfer portion.

5. The image forming apparatus according to claim 4, further comprising:

a plurality of stretching rollers over which the intermediate transfer belt is stretched;

wherein one of the stretching rollers is opposed to the current supply member across the intermediate transfer belt, and the voltage maintaining element is connected to the one stretching roller.

6. The image forming apparatus according to claim 1, wherein a plurality of contact members are disposed corresponding to the plurality of image bearing members.

7. The image forming apparatus according to claim 6, wherein the contact members are each disposed downstream from a nearby image bearing member in the a direction of travel of the intermediate transfer belt.

8. The image forming apparatus according to claim 1, wherein the detecting member is an optical sensor including a light emitting unit configured to emit light to the intermediate transfer belt, and a light receiving unit configured to receive light reflected from the intermediate transfer belt or light reflected from a the test pattern formed on the intermediate transfer belt.

9. The image forming apparatus according to claim 8, wherein the test pattern is a toner pattern for calculating a measurement amount having correlation with a toner amount.

10. The image forming apparatus according to claim 8, wherein the test pattern is a toner pattern for measuring an amount of shift among toner images of different colors.

11. The image forming apparatus according to claim 1, wherein the voltage maintaining element is a Zener diode.

12. An image forming apparatus comprising:

a plurality of image bearing members configured to bear toner images;

an intermediate transfer belt configured to perform secondary transfer onto a transfer medium of a toner image subjected to primary transfer from the plurality of image bearing members, the intermediate transfer belt having been formed endless and rotatably;

a current supply member configured to contact the intermediate transfer belt;

a detecting member configured to detect a test pattern formed on the intermediate transfer belt; and an opposing member configured to oppose the detecting member across the intermediate transfer belt, wherein the opposing member is operable to switchable to be switched between an electrically grounded state and a state in which the opposing member is connected to a voltage maintaining element; and wherein the opposing member to which the voltage maintaining element is connected maintains a predetermined potential by current flowing from the current supply member to the intermediate transfer belt.

* * * * *